US005177933A

United States Patent [19]

Boriani et al.

[11] Patent Number: 5,177,933

[45] Date of Patent: Jan. 12, 1993

[54] MACHINE FOR WRAPPING SUBSTANTIALLY PARALLELEPIPED BOX ELEMENTS

[75] Inventors: Silvano Boriani; Antonio Gamberini, both of Bologna, Italy

[73] Assignee: G.D. Societa per Azioni, Bologna, Italy

[21] Appl. No.: 730,701

[22] Filed: Jul. 16, 1991

[30] Foreign Application Priority Data

Jul. 17, 1990 [IT] Italy ..... 3599 A/90

[51] Int. Cl.[5] ..... B65B 11/06; B65B 49/08; B65B 51/10

[52] U.S. Cl. ..... 53/234; 53/228; 53/375.8; 53/387.4

[58] Field of Search ..... 53/228, 230, 231, 232, 53/234, 375.9, 387.4, 466, 586

[56] References Cited

U.S. PATENT DOCUMENTS

| | | | |
|---|---|---|---|
| 3,040,488 | 6/1962 | Winkler et al. | 53/586 X |
| 3,150,475 | 9/1964 | Schooler | 53/228 X |
| 4,194,340 | 3/1980 | McIntyre . | |
| 4,711,065 | 12/1987 | Focke et al. | 53/234 X |
| 5,003,755 | 4/1991 | Draghetti | 53/234 X |

FOREIGN PATENT DOCUMENTS

| | | |
|---|---|---|
| 524460 | 8/1940 | United Kingdom . |
| 962991 | 7/1964 | United Kingdom . |
| 1112352 | 5/1968 | United Kingdom . |
| 1239108 | 7/1971 | United Kingdom . |
| 2235913 | 3/1991 | United Kingdom . |

*Primary Examiner*—John Sipos
*Assistant Examiner*—Linda B. Johnson
*Attorney, Agent, or Firm*—Cushman, Darby & Cushman

[57] ABSTRACT

A machine for wrapping substantially parallelepiped box elements, typically packs of cigarettes, comprises a push rod by which each box is directed against a respective wrapper of heat-sealable material, and directed together with the wrapper into a pocket, also folders by which the wrapper is closed into a tubular sheath around the box, and a heat-seal device by which the overlapping edges of the wrapper are secured to one another. The folding and heat-seal steps both take place while the box remains positioned in the pocket, with the folders and heat-seal device operating sequentially and in such a way that the overlapping extremities of the wrapper are secured before bring released by the folders, thereby ensuring that the wrapper remains taut.

6 Claims, 2 Drawing Sheets

I
II
III
IV

MACHINE FOR WRAPPING SUBSTANTIALLY PARALLELEPIPED BOX ELEMENTS

BACKGROUND OF THE INVENTION

The present invention relates to a machine for wrapping elements of boxlike and substantially parallelepiped embodiment.

In particular, the present invention relates to a machine by which substantially paralleleliped box elements are enveloped in wrappers of heat-sealable material.

The prior art embraces numerous wrapping machines, and more especially cellophane wrapping machines, by which substantially parallelepiped commodities, notably packs of cigarettes, can be enveloped both individually and in groups. Such machines generally comprise means by which to feed and subsequently index the boxes or packs, also folding means, and sealing means.

Each box element is urged by the feed means against a respective wrapper, which includes a sheet of the heat-sealable material supplied in a direction perpendicular to the feed direction, and directed ultimately into a recess together with the wrapper.

The dimensions of the recess are substantially identical to those of the box element, such that upon insertion, the wrapper is forced into a 'U' shape around the element by the side walls of the recess, with two extremities or flaps projecting.

The folding means, which include a moving folder and a fixed folder, serve to fashion each wrapper into a tubular sheath around the respective box element by engaging the two projecting flaps and flattening them into overlapping contact against one side or face of the element.

Finally, the two overlapping flaps are secured one to the other by the sealing means and the tubular configuration is thus rendered stable.

In many machines, the recess include one of a plurality of radial pockets provided by a rotary wrapping head that is indexed about a horizontal axis through a number of work stations.

The moving folder effects a reciprocating movement, and serves to flatten the lower of the projecting flaps against the rearwardmost face of the box element at a moment immediately following the entry of the element and the corresponding wrapper into the pocket, and immediately prior to the indexing movement of the head.

The fixed folder is provided by the bottom edge of an external hood, or casing, disposed coaxial with the wrapping head in such a way that subsequent rotation of the head has the effect of flattening the upper projecting flap of material over the already folded lower flap and thus completing the operation whereby the wrapper is fashioned into a tubular sheath around the box element.

While it is true that high operating speeds are obtainable with a structure of the type outlined above, there are also certain drawbacks as regards a correct and durable fold of the wrappers around the corresponding box elements.

A correctly folded wrapper is of great importance nonetheless, and a determining factor contributing to the ultimate appearance of the end product.

Accordingly, it is essential that the wrapper be properly taut when folded around the respective box element.

The drawbacks in question derive first and foremost from the fact that, even with the projecting flaps of the wrapper properly folded against the relative side or face of the box element, the requisite tubular configuration of the wrapper does not hold sufficiently stable through until the subsequent heat-sealing operation which, as already suggested, occurs at a time and location posterior to those of the folding operation.

This problem is aggravated in the case of the expedient described above, whereby the box element and the ensheathing wrapper are held in place in the respective pocket, during the rotation of the wrapping head, through the agency of an essentially cylindrical hood or casing. In the course of such rotation, in effect, contact with the inner surface of the casing is limited to the longitudinal corner edges of the exposed face of the box element.

Besides being unable to guarantee that the correct tubular configuration of the wrapper is maintained, the contact in question is difficult to achieve and maintain for two contrasting reasons, namely: too hard a contact may well result in a damaging compression of the longitudinal edges of the rear face of the box element, as well as causing the lower flap, pinched between the fixed casing and the indexing element, to slide away from beneath the upper flap; by contrast, insufficient pressure in the contact between the casing and the element will result in the two flaps being allowed an undue degree of freedom, such that the wrapping material can slacken and the requisite tautness be lost.

Moreover, the wrapper is embodied in an extremely thin and pliable material that readily accumulates an electrostatic charge, a characteristic which complicates the operation of the moving folder, caused as it is to slide in close contact with the lower of the two projecting flaps to the end of flattening the material tightly against the box element. This same sliding action has the effect of inducing an electrostatic charge in the flap, which consequently tends to cling and is drawn back by the folder on the return stroke.

The problem is compounded by the fact that these electrostatic charges increase proportionally with any increase in the velocity of the sliding contact between folder and flap, that is to say with higher operating speeds of the wrapping machine.

As may readily be deduced, in effect, the moving folder tends to drag the lower flap such that it bunches beneath the upper flap, with the inevitable result that the requisite olean, flush overlapping contact cannot be obtained subsequently.

This bunching or creasing of the lower flap leads in turn to a further drawback during the subsequent heat-sealing operation, namely: the fact that one of the two overlapping extremities of the wrapper may be creased signifies a reduction in the surface areas effectively in contact, hence an inevitable reduction in dependability of the heat-sealed joint.

SUMMARY OF THE INVENTION

Accordingly, the object of the present invention is one of structuring a wrapping machine of the type in question in such a way that the heat-sealable sheets of wrapping material are folded correctly into a tubular configuration about their respective box elements and held steady thereafter until the heat-sealing operation has been accomplished, thus eliminating the drawbacks mentioned above.

The stated object is fully realized, according to the present invention, in a machine for wrapping substantially parallelepiped boxlike elements that comprises feed means, by which the box elements are directed against respective wrappers fashioned from a heat-sealable material and transferred as one with the wrappers into a recess proportioned to accommodate the box elements and wrappers together, also folding means by which each wrapper is formed into a tubular sheath about the corresponding box element, and sealing means by which the overlapping extremities of the wrapper are secured one to the other to render the tubular formation stable.

In the machine disclosed, the folding means and the sealing means operate together at a single work station of which the recess forms a part, and are designed to execute the respective folding and heat-sealing operations in a succession of steps, effected substantially without pause, whereby the overlapping extremities of the wrapper are engaged by the sealing means before being released by the folding means, such that the wrapper is held taut over the relative box element until the overlapping surfaces of the wrapper have been heat-sealed one to the other.

BRIEF DESCRIPTION OF THE DRAWINGS

The invention will now be described in detail, by way of example, with the aid of the accompanying drawings, in which.

DESCRIPTION OF THE PREFERRED EMBODIMENT

Figures 1, 2:
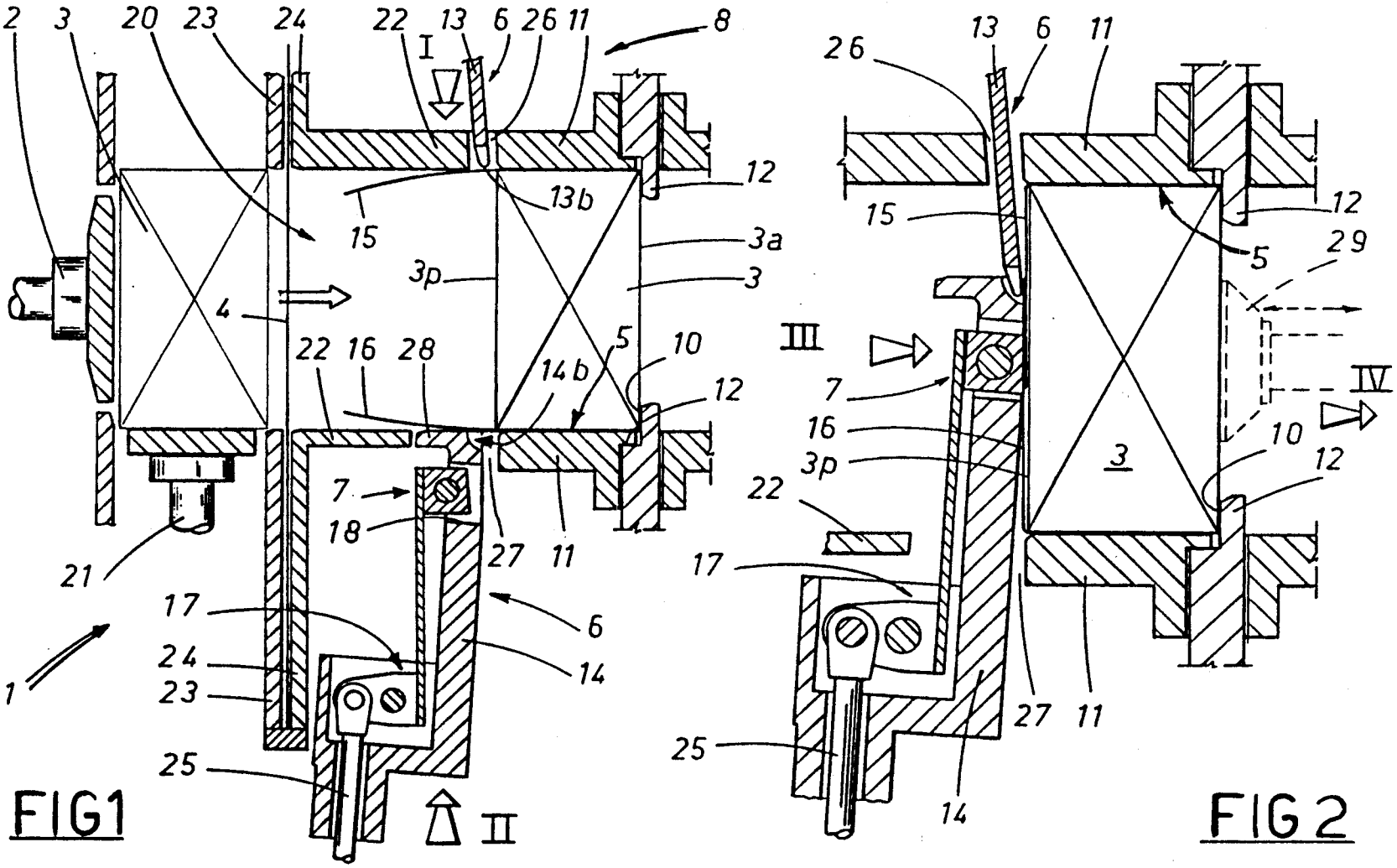
FIGS. 1 and 2 are longitudinal sections through the feed station of a machine according to the present invention.

Referring to the drawings, 1 denotes a machine, in its entirety, handling substantially parallelepiped and boxlike elements 3 to be enveloped in wrappers of heat-sealable material, which comprises feed and transfer means including a reciprocating push rod 2, also folding means 6 and sealing means 7, at least associated with a work station denoted 8. The reciprocating push rod 2 is capable of movement through a rectilinear horizontal trajectory between a retracted position and an extended feed position. Unless otherwise stated during the course of the description, the expressions forward, back, front, and rear, etc., are referred to the feed direction described by the push rod in reciprocating between the retracted and extended positions. Similarly, the general reference to a box element 3 in the context of the specification can indicate a single packet of cigarettes or a group of packets, or indeed any given commodity of parallelepiped shape, singly or collectively, such as might be enveloped in a sheet of heat-sealable wrapping material. The push rod 2 reciprocates internally of a channel 20, through which the box elements 3 are guided from an initial position between the rod 2 and the channel 20, having been directed into place substantially at the moment in which the push rod 2 reassumes the retracted position, for example by means of an elevator 21. The channel 20 is embodied essentially as a pair of horizontal guide plates 22 rigidly associated with a supporting structure (not illustrated) that forms part of the wrapping machine 1.

Numerals 23 and 24 denote two vertical guides associated with the horizontal plates 22 and providing a path down which to direct single sheets of heat-sealable wrapping material. The sheets, or wrappers 4, are supplied to the station from above by conventional means (not illustrated in the drawings,) and brought to rest in a precise position as will become clear in due course.

Numeral 5 denotes a recess positioned in alignment with the push rod 2, by which the single box elements 3 are accommodated together with their wrappers 4. The movement of the push rod 2 toward the extended position terminates at the moment when the box element 3, directed forward by the rod, has entered the interior of the recess 5.

Broadly considered, the recess 5 is created by an inner wall 10 set transverse to the rectilinear trajectory of the box elements 3, and a pair of horizontal walls 11 which occupy the same planes as are occupied by the horizontal plates 22, at least during the passage of the box element 3 into the recess.

The recess 5 generally will be encompassed by a further pair of side walls, vertical and parallel, which are not illustrated. The dimensions of the recess 5 are substantially identical to those of the box element 3, which thus entirely occupies the recess 5 substantially without protruding from its confines. The transverse dimension of the wrapper 4 (+i.e. transverse to the direction through which the wrapper approaches the station 8,) is greater than the corresponding dimension of the box element 3. Accordingly, the wrapper projects from each side or end of the box element 3 and is flattened against the corresponding side or end faces by the vertical side walls as the box element enters the recess 5. The longitudinal dimension of the wrapper 4, and the position in which the wrapper is held prior to being invested by the leading face 3*a* of the box element 3, are such that the wrapper 4 is folded around the box element into a 'U' configuration by engagement with the edges of the recess walls 11, the two extremities of the 'U' projecting rearward as flaps of which the upper is denoted 15 and the lower denoted 16.

The flaps 15 and 16 are flattened against the box element 3 by the folding means 6, and bonded one to the other thereafter by the sealing means. According to the present invention, the folding means 6 and the sealing means 7 are both caused to operate as part of the work station 8 at which the box element 3 is received into the recess 5, being mutually associated and activated in succession, the folding means first, and then the sealing means, substantially without any pause.

Moreover, the sealing means 7 are brought to bear on the flaps 15 and 16 of the wrapper 4 while these plays are still engaged by the folding means 6 and held thus correctly tensioned.

With particular reference to the example of FIGS. 1 and 2, the folding means 6 include a pair of substantially flat elements 13 and 14 positioned in vertical alignment on opposite sides of the guide channel 20 and traversed toward or away from one another, by means not illustrated, in a vertical plane normal to the direction of movement of the push rod 2.

The traversing plane of the flat elements 13 and 14 is separated from the inner wall 10 of the recess 5 by a distance which is substantially equal to the depth of the box element 3, i.e. the dimension as measured along the direction of movement of the push rod 2. The movement of the flat elements 13 and 14 is such that the sum of their strokes is greater than the distance by which they are separated when fully spread apart. Accordingly, the leading edges 13*b* and 14*b* of the two elements exhibit complementary profiles that allow them to overlap without mutual contact.

As is discernible from FIGS. 1 and 2, the flat folding elements 13 and 14 are angled marginally from their traversing plane in order to reduce the amount of electrostatic charge generated in the wrapper 4. The bottom flat element 14 exhibits a more robust structure than the top element 13, and carries a two-arm lever 17 which is pivotably anchored to the side opposite that which enters into contact with the wrapper 4. It is to this lever 17, and more exactly to the tip of one of the two arms adjacent to the shaped leading edge 14*a* of the flat element 14, that the conventional sealing means 7 are mounted.

The flat element 14 provides an opening 18 alongside the leading edge 14*a*, through which the sealing means 7 are able to pass and enter into contact with the wrapper 4.

The remaining arm of the lever 17 articulates with a control rod 25 which is set in motion axially (by means not illustrated) and serves to rotate the lever 17 in opposite directions between two limit positions, whereby the sealing means 7 are brought into direct contact with or distanced from the wrapper 4, respectively.

As illustrated in FIGS. 1 and 2, and as discernible clearly from FIG. 2, the face of the flat element 14 that engages in contact with the folded wrapper 4 is disposed parallel with the inner wall 10 of the recess 5. The face in question occupies an area surrounding the opening 18, for a reason that will become clear in due course.

Numerals 26 and 27 denote top and bottom openings located between the guide plates 22 and the side walls 11 of the recess 5, serving to allow the passage of the flat elements 13 and 14. The dimension of the bottom opening 27 measured along the direction of movement of the push rod 2 is greater than the corresponding dimension of the top opening 26, by reason of the bulk of the bottom flat element 14 and the sealing means 7, which naturally must be greater than that of the top flat element 13 alone. Any obstruction that might be caused by the bottom opening 27 to the progress of the box elements 3 is precluded by the incorporation of an appendage 28 into the bottom element 14 at its leading edge 14*b*, embodied in such a way as to occupy the same plane as the bottom guide plate 22 when the bottom flat element 14 is in the lowered position and thus substantially restore continuity between the guide plate 22 and the wall 11 of the recess.

In the embodiment illustrated, the inner wall 10 effectively includes two vertical stops 12, which are positioned on opposite sides of the recess 5, occupying a common plane parallel to the wall 10 and capable of movement therein toward and away from one another, between a position drawn together, in which an advancing box element 3 is intercepted, and a position spread apart, in which an advancing box element 3 is not intercepted.

Operation of the wrapping machine 1 according to the invention will now be described, starting from a situation in which the push rod 2 is retracted and the elevator 21 is in the process of introducing a box element 3 to be ensheathed in a corresponding wrapper 4. At the moment when the elevator 21 draws into alignment with the bottom guide plate 22, the elements 13 and 14 of the folding means will be in the drawn apart position and the sealing means 7 will be in the at-rest position of FIG. 1. The push rod 2 is now actuated and extends along the feed direction, entering into contact with the rearwardmost face 3*p* of the box element 3. The forwardmost face 3*a* thus invests the wrapper 4 which was previously fed into position between the vertical guides 23 and 24, whereupon the box element 3 is carried fully forward into the recess 5, pinning the wrapper 4 against the inner wall 10, i.e. against the movable stops 12, which are currently are drawn together and motionless in the intercepting position.

As the push rod 2 proceeds forward, the wrapper 4 is folded into a 'U' shaped configuration around the box element 3 by the edges of the horizontal walls 11, and tautened gradually as the result of friction with the plates 22, with the appendage 28 and with the walls 11 themselves. The moment that the push rod 2 has completed its forward stroke, the folding means 6 begin drawing together, the top element 13 first and then the bottom element 14, entering into contact with the upper and lower flaps 15 and 16, whereupon the push rod 2 commences its return to the retracted position. Accordingly, the vertical space occupied by the push rod 2 is less than that occupied by the box element 3, as discernible in FIGS. 1 and 2.

The upper flap 15 is folded against the relative face 3*p* of the box element 3 by the corresponding flat element 13, which remains in contact with the flap 15 through a distance equal to approximately half the length by which the flap 15 projects from the box element 3. Thereafter, the lower flap 16 is flattened by the remaining element 14 against the same face 3*p* of the box element 3, overlapping the flap 15, which was folded previously. The bottom element 14 passes almost entirely across the lower flap 16, extending to the point where the sealing means 7 are brought into alignment with the area of overlap between the two flaps 15 and 16 of the wrapper 4. Once the bottom flat element 14 is fully forward with its parallel face disposed entirely in contact with the lower flap 16, the control rod 25 is actuated to direct the sealing means 7 onto the overlapping flaps 15 and 16, firmly against the box element 3. The sealing means 7 are activated to secure the flaps 15 and 16 together, then returned to their normally retracted at-rest position. Thereafter, the flat elements 13 and 14 are drawn apart in readiness for a further folding and heat-sealing operation.

It will be evident beyond doubt that the wrapper 4, and in particular the overlapping flaps 15 and 16, have no opportunity of receding once folded, given that the folding and heat-sealing operations are substantially simultaneous. Once folded, moreover, the flaps 15 and 16 are held positively and without interruption against the corresponding face 3*p* of the box element 3 until after a heat-seal has been effected. Thus, the wrapper 4 is fashioned into a tubular sheath around the respective box element 3 and suitably tensioned, then heat-sealed while continuing to be held taut by the selfsame folding and tensioning means. Notwithstanding that there may be electrostatic charges induced in the flaps 15 and 16 by the return movement of the flat elements 13 and 14, there can be no adverse effects, given that the flaps 15 and 6 have already been sealed before the elements 13 and 14 are withdrawn.

With each heat-seal operation completed, suitable transfer means are activated to distance the box element 3, now partly enveloped by a wrapper 4 folded into a tubular sheath and secured by an overlapping longitudinal joint.

Figure 3:
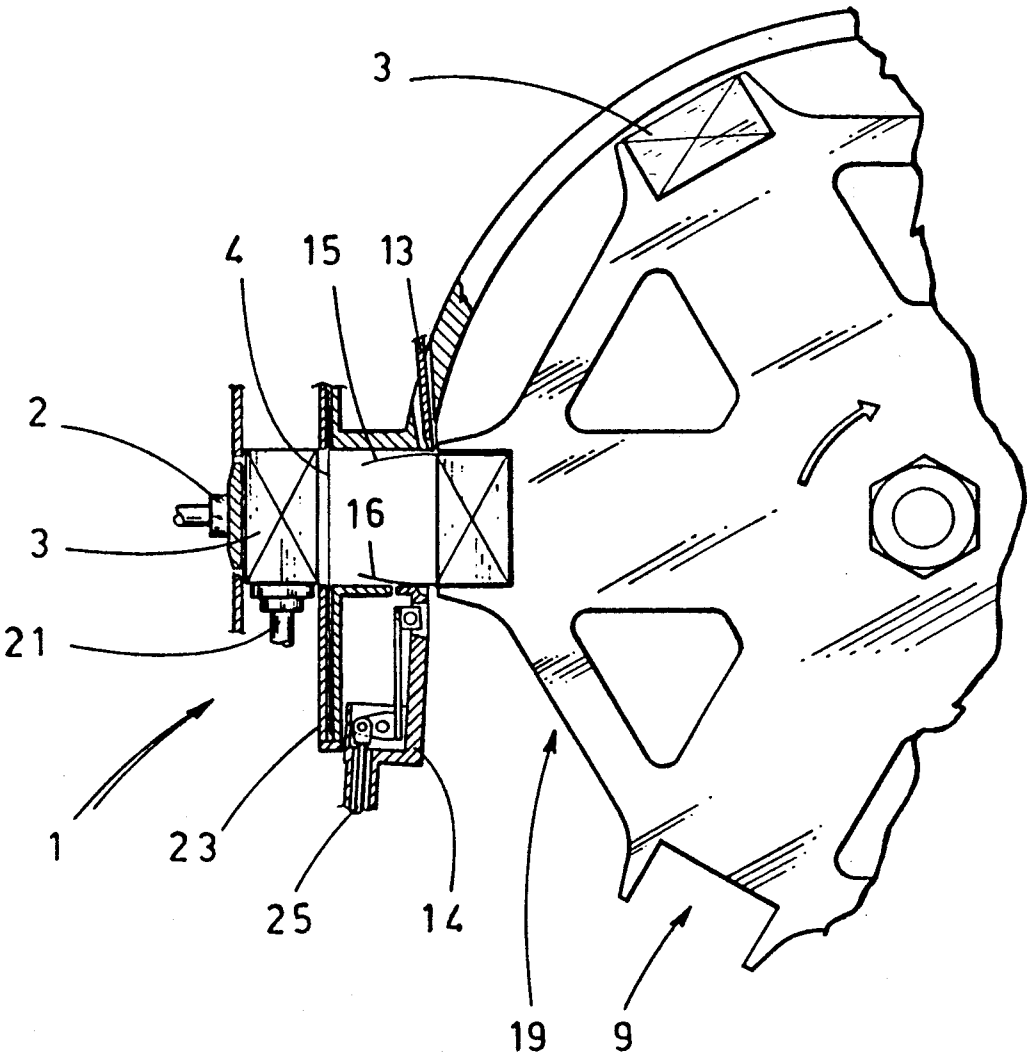
FIG. 3 is an illustration, on smaller scale, of a wrapping head forming part of the machine according to the present invention.

In the example of FIG. 3, the recess 5 appears as one of a plurality of equispaced radial pockets 9 provided by a rotary wrapping head 19 which is arranged to be indexed about a horizontal axis. In this arrangement, the inner wall 10 may be fixed in relation to the head 19 and embodied with a hole providing passage to means of conventional embodiment (not illustrated) by which the box elements 3 are ejected from each pocket 9 in turn. The wrapping head 19 is described no further, being conventional in embodiment. The notion of embodying the inner wall 10 of the pocket 5 as two movable stops 12 will be seen to offer significant advantages, given that the partly enveloped box elements 3 can be ejected by passing forward when the stops 12 are spread apart. Thus, the pocket 5 becomes part of a continuous channel incorporating means at a given location, in this instance the stops 12, by which the box elements 3 can be detained temporarily. The box elements 3 can be distanced by negative pressure means 29, for example, offered to the forwardmost face 3*a* of the wrapped element 3 (as in FIG. 2).

The option also exists of displacing and distancing the box elements 3 with heat-sealed wrappers by causing successive elements with as yet unsealed wrappers to act as pushing means.

Both solutions enable a reduction in the duration of the folding and heat-sealing cycle, hence a higher operating speed of the wrapping machine 1. Providing that the various steps of the cycle are appropriately calculated, in effect, the push rod 2 can commence its forward stroke against the box element 3 even as the flat elements 13 and 14 begin drawing apart upon completion of the heat-sealing operation. More exactly, as the push rod 2 moves forward with a further element 3 and the folding means 13 and 14 recede, the movable stops 12 will spread, the last box element 3 to be ensheathed in its wrapper 4 is removed by the ejection means 29, and immediately as the wrapped box element 3 has passed through, the movable stops 12 can draw together to reinstate the inner wall 10 in readiness to intercept the next box element 3 together with the relative wrapper 4, duly folded into 'U' shaped formation.

What is claimed is:

1. A machine for convolutely wrapping a parallelepiped box-like element having opposed first and second faces, opposed third and fourth faces and opposed fifth and sixth faces, with a sheet of flexible and heat sealable wrapping material about said first, third, second and fourth faces and heat sealing, corresponding overlapped regions of the resulting wrapper to one another against said second face to provide a wrapped element, comprising:

transversally spaced first and second wall means defining between them a recess sized to slidingly accommodate said element, with first face leading, said second face trailing and a first respective thickness of said sheet of wrapping material interposed between said third face and said first wall means and a second respective thickness of said sheet of wrapping material interposed between said fourth face and said second wall means; said first and second wall means also defining between them a pathway longitudinally extending parallel to said first and second wall means and along which said box-like element can be moved from an upstream end towards a downstream end of said first and second wall means;

means for receiving a sheet of flexible, heat sealable wrapping material athwart said recess at said upstream end of said first and second wall means:

means for supplying a parallelepiped box-like element into position upstream of said sheet of wrapping material and in axial alignment with said recess, with said first face thereof leading;

reciprocating push rod means engageable with said second face of said element for stuffing said element into said sheet of wrapping material longitudinally along said pathway and thereby inserting said element, with said sheet of wrapping material wrapped about said third, first and fourth faces thereof, into said recess, with two flaps of said sheet of wrapping material trailing;

first and second stop means associated with said first and second wall means and being transversally movable between a first, projected position in which they effectively obstruct said recess at a downstream location, and a second, withdrawn position in which they effectively permit longitudinal passage therepast of said element wrapped by said wrapper;

said reciprocating push rod means when engaged with said second face of said element being adapted to stuff said element, with said sheet of wrapping material wrapped about said third, first and fourth faces thereof so far along said pathway that said first face of said element, with a thickness of said sheet of wrapping material thereon, engages said first and second stop means, thereby defining a wrapping and sealing location in said recess for said element;

means defining a first slot through said first wall means at a location which is longitudinally spaced upstream from said first stop means by an amount which is effectively equal to the comparable dimension of said third face of said element longitudinally of said pathway, plus two thicknesses of said sheet of wrapping material;

means defining a second slot through said second wall means at a location which is longitudinally spaced upstream from said second stop means by an amount which is effectively equal to the comparable dimension of said fourth face of said element longitudinally of said pathway, plus two thicknesses of said sheet of wrapping material;

a first folder disposed for movement transversally of said pathway at said first slot, between a withdrawn position, in which said first folder is located effectively outside said recess, and a second position in which said first folder projects into said recess immediately upstream of said element having said two flaps trailing, so as to fold and hold a first one of said flaps flatwise against said second face of said element;

a second folder disposed for movement transversally of said pathway at said second slot, between a withdrawn position, in which said second folder is located effectively outside said recess, and a second position in which said second folder projects into said recess immediately upstream of said element having a second one of said two flaps trailing, so as to fold and hold said second flap flatwise against said second face of said element, with two corresponding regions of said first and second flaps disposed in overlapping relation;

heat sealing means associated with one of said folders so as to be effectively carried into and out of said recess thereby, and actuable while said first and second folders are in said second positions thereof, for heat sealing said corresponding regions of said first and second flaps to one another;

said first and second folders having respective foremost edges which first enter said recess as said folders are moved from said first positions thereof towards said second positions thereof, and respective leading faces extending from the respective said foremost edges and which face downstream when said first and second folders are disposed in said second positions thereof; and said leading faces of said folders angling towards upstream from the respective said foremost edges thereof so as to tend to localize to said foremost edges contact of said folders with respective ones of said flaps as said folders are moved from said first positions thereof to said second positions thereof.

2. The wrapping and sealing machine of claim 9, wherein:

said heat sealing means is movably associated with said one of said folders, for movement generally longitudinally of said passageway between an upstream position spaced out of contact with said corresponding regions of said first and second flaps, and a downstream position engaging a convolutely outermost one of said corresponding regions.

3. The wrapping and sealing machine of claim 2, wherein:

said one of said folders has means defining an opening therethrough, facing downstream with respect to said pathway when said one of said folders is disposed in said second position thereof; said heat sealing means being disposed to move through said opening for reaching said downstream position thereof, and for retracting into said one of said folders to said upstream position thereof.

4. The wrapping and sealing machine of claim 2, wherein:

said push rod means is sufficiently narrow transversally of said recess between said first and second wall means, as to permit said first and second folders to begin folding respective ones of said flaps against said second face of said element, before withdrawing longitudinally upstream.

5. The wrapping and sealing machine of claim 2, wherein:

said first and second wall means are each coordinately divided into two portions, namely an upstream portion and a downstream portion longitudinally between said slots and said wrapping and sealing location in said recess for said element; and a structure carrying said downstream portion of said first and second wall means and being movable generally transversally relative to said upstream portion of said first and second wall means, for carrying away said wrapped element.

6. The wrapping and sealing machine of claim 2, further including:

means for extracting said wrapped element from said recess.

* * * * *